US005718374A

United States Patent [19]

Cnossen

[11] Patent Number: 5,718,374

[45] Date of Patent: Feb. 17, 1998

[54] HEATING DEVICE

[76] Inventor: Jan Henk Cnossen, Koudum, Netherlands

[21] Appl. No.: 687,454

[22] PCT Filed: Jan. 24, 1995

[86] PCT No.: PCT/NL95/00034

§ 371 Date: Jul. 23, 1996

§ 102(e) Date: Jul. 23, 1996

[87] PCT Pub. No.: WO95/20132

PCT Pub. Date: Jul. 27, 1995

[30] Foreign Application Priority Data

Jan. 24, 1994 [NL] Netherlands ..... 9400106

[51] Int. Cl.[6] ..... F24D 3/00

[52] U.S. Cl. ..... 237/8 R; 237/56

[58] Field of Search ..... 237/8 R, 56, 66; 137/487.5

[56] References Cited

U.S. PATENT DOCUMENTS

| | | | |
|---|---|---|---|
| 4,013,221 | 3/1977 | Eder | 237/66 |
| 4,263,498 | 4/1981 | Meyers | 237/66 |
| 4,277,021 | 7/1981 | Daye | 237/56 |
| 4,345,715 | 8/1982 | Van Craenenbroeck | 237/66 |
| 4,601,426 | 7/1986 | Brosenius | 237/56 |
| 4,723,705 | 2/1988 | Persson | 237/66 |
| 4,733,721 | 3/1988 | Piotrowski et al. | 237/66 |
| 5,007,583 | 4/1991 | Schwarz | 237/66 |
| 5,456,409 | 10/1995 | Roffelsen | 237/66 |

FOREIGN PATENT DOCUMENTS

| | | |
|---|---|---|
| 878 407 | 12/1979 | Belgium . |
| 0 543 285 | 5/1993 | European Pat. Off. . |
| 0 614 054 | 9/1994 | European Pat. Off. . |
| 43 06 197 | 9/1994 | Germany . |
| 7612644 | 5/1978 | Netherlands . |

*Primary Examiner*—Harold Joyce
*Assistant Examiner*—Derek S. Boles
*Attorney, Agent, or Firm*—Evenson, McKeown, Edwards & Lenahan, P.L.L.C.

[57] ABSTRACT

The invention relates to a heating installation. The installation comprises a closed liquid circuit which is under pressure during operation, a pressureless liquid reservoir, an actuable pump with an inlet connected to the reservoir and an outlet connected to the circuit, actuable draining means for draining liquid out of the circuit to the reservoir, pressure detecting means for detecting the pressure in the circuit and control means for activating the pump when exceeding of a minimum pressure in negative direction is detected and for activating the draining means when exceeding of a maximum pressure in positive direction is detected.

16 Claims, 2 Drawing Sheets

HEATING DEVICE

The invention relates to a heating installation of the type which operates with a closed liquid circuit which is under pressure during operation. Incorporated on the one hand in the liquid circuit is a heating boiler in which heat is supplied to the liquid circulating in the circuit. Incorporated on the other hand in the liquid circuit are radiators and/or convectors by means of which heat is generated from the liquid to spaces for heating. Instead of or in addition to convectors and radiators an air transporting system can be used.

Heating installation of this type normally comprise a pressure expansion tank. Accommodated herein is the extra volume of liquid resulting from expansion as a result of heating of the liquid. When the liquid in the liquid circuit cools, liquid is carried from the pressure tank back into the circuit again to compensate the volume decrease due to this cooling.

Due to very small leakages in the system some loss of liquid occurs in the course of time. Through decomposition resulting from electrolysis or bacteriological action and through evaporation a part of the liquid also passes into a gaseous phase which is discharged from the system. The amount of liquid in the system thereby decreases gradually during normal use. The lost liquid must therefore be supplemented periodically. This is a time-consuming operation wherein a temporary connection to for instance the mains water supply is effected and, using the pressure in the mains water supply, water is pressed into the liquid circuit.

In addition, the known pressure tanks have a limited lifespan.

The invention has for its object to provide a heating installation of the type specified in the preamble which requires little maintenance and attention over a long period.

This object is achieved with the heating installation comprising a closed liquid circuit which is under pressure during operation, a pressureless liquid reservoir, an actuable pump with an inlet connected to the reservoir and an outlet connected to the circuit, an actuable drain to drain liquid out of the circuit to the reservoir, a pressure detector to detect the pressure in the circuit, a control to activate the pump when exceeding of a minimum pressure in a negative direction is detected and for activating the drain when exceeding of a maximum pressure in a positive direction is detected. Through use of a pressureless liquid reservoir with an actuable pump and actuable draining means, a number of advantages are achieved in a closed liquid circuit which is under pressure during operation. The pressure in the liquid circuit can be held constant within very narrow limits, for instance 0.2 bar. The boiler, radiators and the like therefore require a less heavy construction since no great pressure variations have to be absorbed.

The liquid which enters the liquid reservoir undergoes a fall in pressure, whereby any gases which may be dissolved in the liquid are easily released. This is because the saturation level for gases absorbed into the liquid decreases together with the pressure. The liquid carried out of the circuit to the liquid reservoir is thus degassed to the degree of saturation associated with the lower atmospheric pressure. When this thus degassed liquid is returned to the liquid circuit where the pressure is higher this liquid is unsaturated. Gas occurring freely in the circuit consequently dissolves in the liquid and is eventually discharged again into the reservoir. Because during heating and cooling of the installation liquid is transported in each case to and fro to the reservoir and back, the liquid in the circuit will be quickly degassed and accumulations of gas in the circuit itself will be avoided almost entirely. Oxygen absorbed into the liquid is very quickly removed therefrom so that internal oxidation and bacteria growth in the system are avoided. In the case of a just filled system the liquid can be degassed very rapidly by varying within permissible limits the minimum and maximum pressure detected with the control means. If use is made of a computer control this variation can be programmed. By lowering the threshold values liquid will be drained from the system in forced manner via the draining means and by increasing the threshold values liquid will again be pumped out of the reservoir into the circuit. By repeating this cycle for a determined time the gas present in the circuit is as it were "pumped" to the reservoir and there released.

In a preferred embodiment, the control means have further only to contain herein a pressure-sensitive switch for the actuable pump so that the invention can also be applied for small installations, wherein the cost price is an important factor.

In another preferred embodiment a cover floating on the liquid is arranged in the reservoir. The cover separates the free liquid surface from the ambient air so that in the reservoir no air can dissolve in the liquid, and in particular the water.

In a more preferred embodiment, a non-return valve allowing passage of gas in an upward direction is incorporated in the cover. The gas released by the pressure decrease in the reservoir can escape simply without air being able to enter the liquid in the reverse direction.

In order to ensure that the cover also moves downward in reliable manner when the liquid level falls, the cover preferably comprises a downward extending casing. Even if the cover does not close all the way round in the reservoir, a virtual vacuum is applied under the cover when the liquid level falls, so that a very considerable downward force is exerted on the cover.

According to a further embodiment, the heating device comprises a level detector to detect the liquid level in the reservoir. By detecting the level in the reservoir the proper operation of the installation can be monitored. If for example a tap water heat exchanger is included in the liquid circuit, too high a liquid level in the liquid reservoir can indicate a leakage in this heat exchanger. Too low a liquid level implies a warning that liquid must be added and/or that a leakage has occurred in the system. Replenishment of the installation to compensate for leakage losses and the like can take place very simply by causing for instance water from the mains supply to flow into the reservoir. Because the reservoir is pressureless no particular safety measures have to be taken to prevent water flowing back into the mains water supply. In this respect the liquid source is connected by an actuable valve to the reservoir, wherein the level detector can detect at least a lowest level and the control activates the valve when the lowest level is exceeded in negative direction. The amount of water is hereby held automatically at the correct value. Intervention by an operative is not necessary. The installation can hereby remain functioning reliably to a very considerable extent without supervision.

According to a further embodiment a recorder is provided to record the number of occasions per unit of time that the valve is activated. If the recording indicates that the valve is activated on a larger number of occasions per time unit than usual, this indicates a leakage in the system. The control means can be provided in simple manner with an alarm system which in this case warns a supervisor.

The reservoir can suitably comprise an overflow connected to an outlet. If the reservoir is mounted at a low point of the full installation, the liquid can for instance be drained from the installation for maintenance operations by activating the draining means manually or via the control device. The liquid then flows to the reservoir and therefrom is drained via the overflow. By opening the circuit at a high point air can enter the system whereby the liquid is drained from the whole circuit. Refilling of the installation takes place simply by supplying the desired liquid, for instance water, into the reservoir and activating the pump. When use is made of a liquid source connected to the reservoir by an actuable valve, wherein the valve is controlled by level detecting means, in order to fill the circuit only the normal operating situation for the pressure detection means has to be adjusted to detect the pressure in the circuit. As soon as the circuit is filled and the venting opened at a high point is closed, the heating installation is automatically ready for use. Degassing of the freshly supplied liquid thereafter takes place within a very short time in the above described manner by transporting liquid back and forth between the circuit and the reservoir.

In a suitable further development a filter is received in a connecting conduit between the reservoir and the circuit, through which filter the liquid transported back and forth is filtered each time and any parts floating in the liquid are thus removed from the circuit.

The invention will be further elucidated in the following description with reference to the embodiments shown in the figures.

Figure 1:
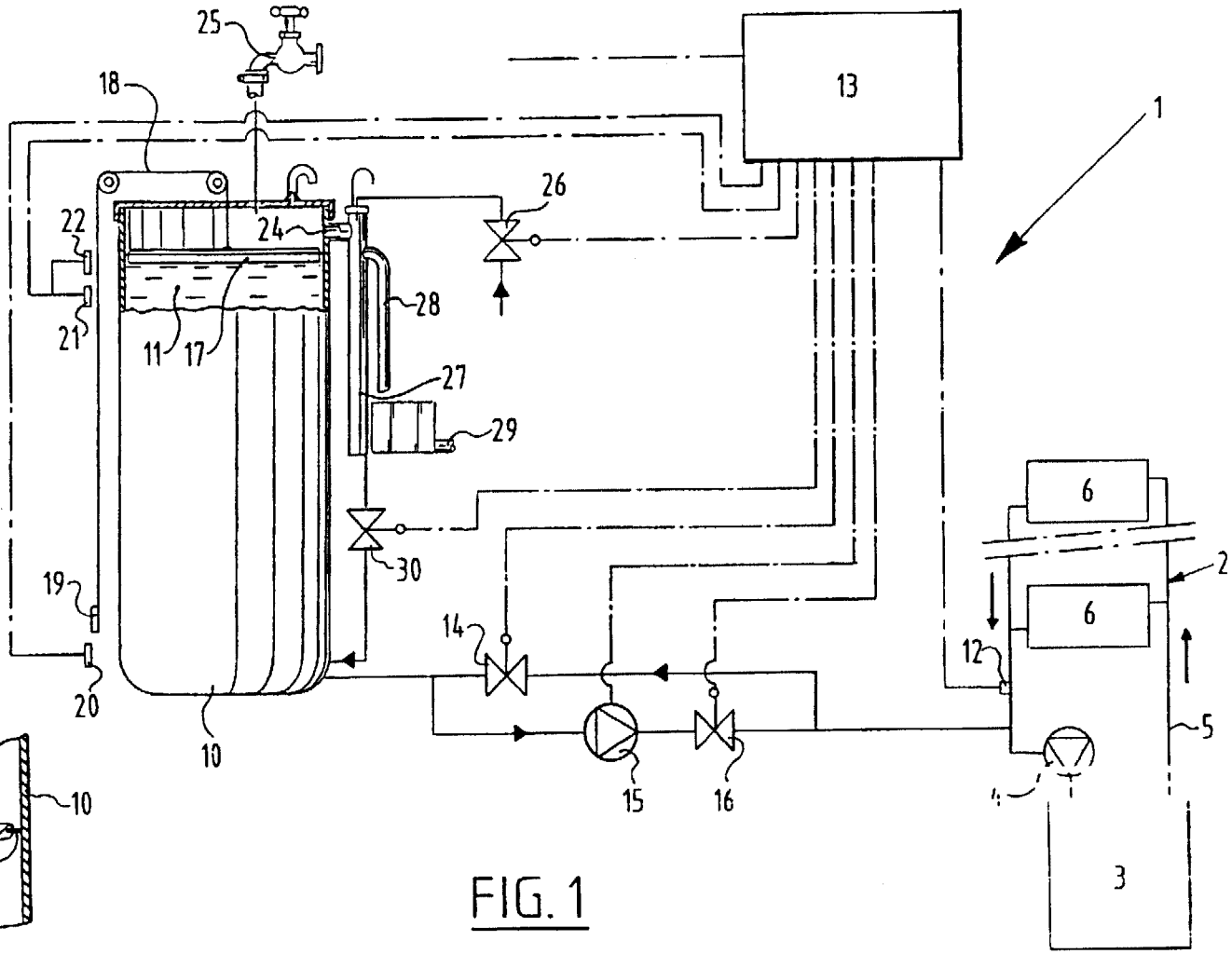
FIG. 1 shows schematically a heating installation according to a first embodiment of the invention.

The heating installation 1 as shown schematically in FIG. 1 comprises a closed liquid circuit 2 which is under pressure during operation. This liquid circuit 2 comprises a pipe system 5 incorporating a heating boiler 3, a circulation pump 4 and radiators or convectors 6. Through the action of the pump 4 liquid circulates through the circuit 2. The liquid is heated in boiler 3 and delivers its heat to the spaces for heating in the radiators or convectors 6. Such a liquid circuit is generally known per se as a central heating system.

Connected to circuit 2 is a liquid reservoir 10 in which liquid 11 is held. Excess liquid can be transported out of circuit 2 to reservoir 10 and back again.

The heating installation 1 further comprises pressure detecting means in the form of a pressure sensor 12 which is connected to circuit 2 and to control means 13. When the pressure detecting means detect that the pressure of the liquid in circuit 2 rises above a value set for instance with control means 13, the control means 13 activate a valve 14 which is arranged in the connecting line between circuit 2 and reservoir 10. Since the liquid in circuit 2 is under pressure it flows toward the reservoir 10 when valve 14 is opened. The valve 14 is closed as soon as pressure sensor 12 detects that the pressure in circuit 2 has again fallen below the maximum permissible value.

When the pressure detecting means detect that the pressure in circuit 2 falls below a set minimum value, for instance due to cooling of the liquid in liquid circuit 2, the control means 13 open the valve 16 and pump 15 is activated. Pump 15 is connected with its inlet to reservoir 10 and with its outlet via valve 16 to circuit 2. By switching on pump 15 liquid 11 is pumped out of reservoir 10 into circuit 2. As soon as the pressure detecting means detect that the pressure in circuit 2 has again risen above the minimum permissible value, the valve 16 is closed again and pump 15 deactivated. Transporting of liquid back and forth in this manner between circuit 2 and reservoir 10 takes place constantly during the normal operation of heating installation 1.

The minimum and maximum pressure at which the control means 13 activate respectively the pump 15 and the valve 14 can be adjusted with a small difference so that the pressure in circuit 2 remains substantially constant. This results in a substantially constant load of the components forming part of circuit 2, which is favourable for the lifespan thereof.

As shown in FIG. 1, a cover 17 floating on the liquid 11 is arranged in reservoir 10. This cover 17 ensures that no direct contact between the ambient air and the liquid 11 occurs so that in the reservoir no air dissolves in the liquid 11.

The liquid which is drained to reservoir 10 via the valve 14 when the set maximum pressure in the liquid circuit 2 is exceeded undergoes a reduction in pressure. Gases dissolved in this liquid are thereby released into reservoir 10. The dissolved gases can escape along the edge of the cover 17.

Because liquid is transported between the circuit 2 and reservoir 10 during operation of heating installation 1, parts of the circuit liquid are thoroughly degassed each time in the liquid reservoir 10, whereby the total amount of liquid in circuit 2 is degassed very rapidly and formation is prevented in the circuit 2 itself of gas volumes which have an unfavourable effect on the operation of the heating installation.

As FIG. 1 shows, the liquid reservoir 10 is provided with level detecting means. These are connected in this embodiment to the cover 17 and comprise a cable 18 bearing on its end an activating member 19 which co-acts with sensors 20, 21, 22. Cable 18 is trained over pulleys. When cover 17 moves downward the activating member 19 moves upward and vice versa.

The sensors 20–22 are coupled to the control means 13. When the liquid 11 is at the lowest permissible level, that is, when cover 17 is situated at the bottom of reservoir 10, sensor 22 is activated by the activating member 19. As soon as the control means thus detect that the liquid 11 has reached the lowest permissible level a supervisor can be alerted who can simply supply liquid to the reservoir 10 by operating a schematically designated tap 25 in order to replenish the evident loss.

An automatic make-up of the heating liquid 11 can be effected instead in the heating installation 1. As soon as the control means 13 detect the minimum permissible level in the above described manner, a valve 26 connected to a liquid source is activated. This liquid source is usually the mains water supply in the case the liquid in the liquid circuit comprises water. With opening of valve 26 the valve 30 is also opened by control means 13. The water from the mains supply flows via valve 26 into the receiving tube 27 and via valve 30 into reservoir 10. The level of the liquid 11 in reservoir 10 thereby rises and, as soon as the activating member 19 activates sensor 21, the control means 13 will switch off valve 26 and subsequently valve 30.

Collected in receiving tube 27 in the first instance is the liquid which escapes from reservoir 10 via the opening 24 at the top of reservoir 10. Small quantities of overflown liquid are thus returned to the system as soon as the valve 30 is opened.

When more liquid is drained from reservoir 10 via opening 24 than the tube 27 can contain, this excess liquid will be drained via overflow 28 to the sewer outlet 29.

Figure 2:
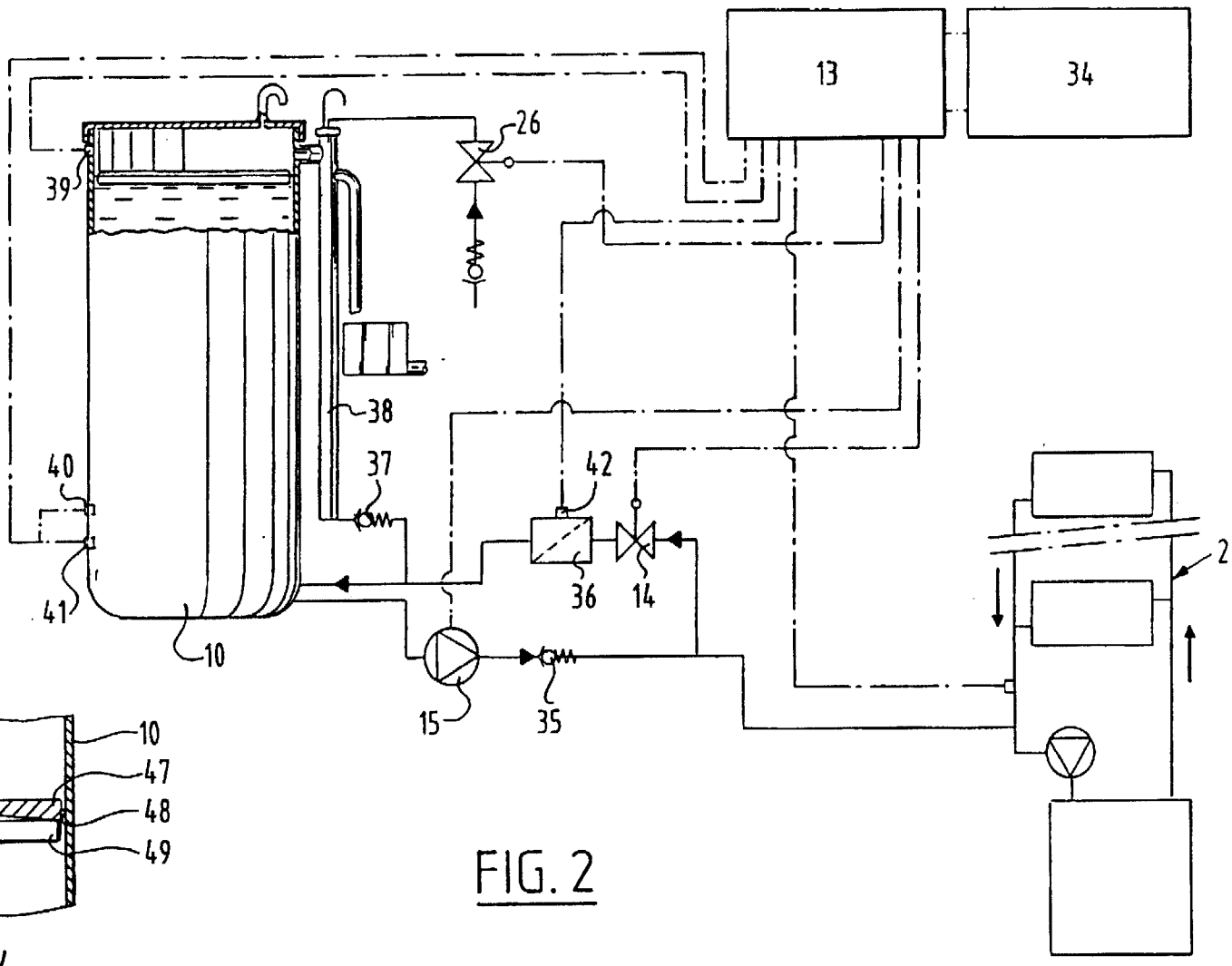
FIG. 2 shows a diagram corresponding with FIG. 1 of a second embodiment.

The embodiment of FIG. 2 corresponds for the most part with that of FIG. 1. Corresponding parts are designated with the same reference numerals.

In this second embodiment of the heating installation operating means are designated with 34 which are coupled to the control means 13. Via these operating means 34 the different operational parameters of the heating installation can be adjusted in suitable manner. These parameters are for instance the maximum and minimum pressure permissible in the liquid circuit 2 and parameters for monitoring the proper operation of the heating installation. These parameters determine for instance when a supervisor must be alerted.

In the embodiment of FIG. 2 the actuable valves 16 and 30 are further replaced by non-return valves 35 and 37 respectively. The control means 13 can hereby be embodied more simply. A filter 36 is further arranged in the connecting line between the circuit 2 and the reservoir 10 in which are accommodated the actuable draining means in the form of valve 14. The liquid drained from circuit 2 to reservoir 10 passes through filter 36 so that constituents floating therein are filtered out. As is shown clearly in FIG. 2, the flow through the filter 36 is only in the direction toward the reservoir 10. Filter 36 can be provided with a sensor 42 which is connected to control means 13 and which detects the degree of fouling of the filter 36, for instance by measuring the pressure over the filter. With the operating means 34 an above mentioned parameter can be adjusted which indicates the limit value for the detected degree of fouling and on the basis of which a warning signal is generated. When this warning signal is given the filter 36 must be replaced or cleaned.

The receiving tube 38 takes a longer form in the embodiment of FIG. 2. With the use of the above mentioned non-return valve 37 liquid will flow out of the receiving tube 38 via non-return valve 37 back to reservoir 10 when the liquid level in reservoir 10 falls. When valve 26 is switched on for replenishing of reservoir 10, water is fed from the mains water supply into the receiving tube 38 and this water flows via non-return valve 37 to reservoir 10. In the above described manner the valve 26 is switched on when the liquid level in reservoir 10 falls below the level corresponding with sensor 41. Valve 26 is closed again when the liquid has reached the level corresponding with sensor 40. Sensor 39 detects a maximum level in reservoir 10 which is only reached in exceptional conditions and which will cause the control means 13 to generate a warning signal. During each replenishment a fixed quantity of liquid is thus supplied in each case, that is, a quantity corresponding with the level difference between sensors 40 and 41. By recording the number of replenishments it is thus possible to keep precise track of how much liquid is supplied to the system. Parameters such as hardness and acidity of the liquid in the system can consequently be calculated accurately in each case. Thus can be determined when steps must be taken to recondition the liquid. A complete control system for the water quality is thus possible with the invention.

Figure 3:
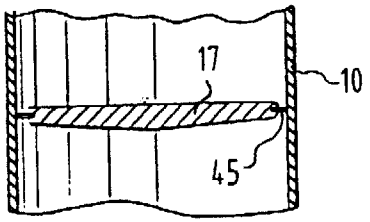
FIG. 3 shows an embodiment of a cover for use in the reservoir of the installation.

The cover 17 for the reservoir 10 shown in FIG. 3 has a simple embodiment. Cover 17 consists of a disc which is provided on its edge with a sealing strip 45 which lies sealingly against the inner wall of reservoir 10. Cover 17 is lighter than the liquid 11 so that when the liquid level rises the cover 17 is pushed upward. When the liquid level falls the cover 17 will sink therewith under the influence of its own weight and because the sealing edge 45 ensures that no air can enter below cover 17.

Figure 4:
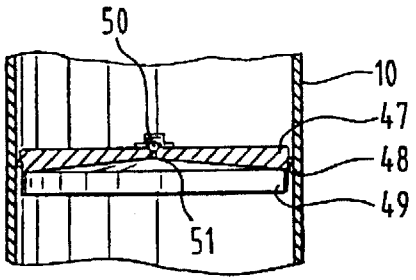
FIG. 4 shows another embodiment of the cover.

In the embodiment shown in FIG. 4 the cover 47 is likewise lighter than the liquid 11 so that it can float on the liquid 11. Cover 47 is likewise in all-round sealing contact with the wall of reservoir 10 by means of a seal 48.

Formed in the middle of cover 47 is a channel 51 on which lies a ball 50. The latter forms with the opening of the channel 51 a non-return valve which allows passage of gas upward but closes off passage in the downward direction. Gas released due to the degassing effect can thus escape simply, while no air can penetrate underneath the cover 47 from above.

The downward extending casing 49 formed on cover 47 ensures that when the liquid level under cover 47 falls a vacuum is formed inside the casing 49, whereby cover 47 is also pulled downward in reliable manner. The friction caused by sealing 48 can hereby be considerable without the good mobility of the cover 47 being unfavourably affected.

The control and operating means 13, 34 can suitably comprise units which monitor the proper operation of the system. These can for instance comprise recording means for recording the number of occasions per unit of time that the valve 26 is activated. An increase in this frequency can indicate leakage in the system. A check is then desirable. A warning signal can also be generated when the level in reservoir 10 reaches the maximum value defined by respectively sensors 20 and 39. As noted above, this can indicate liquid supply into the system, for instance as a result of a leak in a tap water heat exchanger. The usual monitoring of pressure and temperature in the liquid circuit can of course also be added. Warning can take place via a warning lamp or buzzer or also remotely through for instance a semaphone connection.

Although the invention is elucidated here with reference to the description of a space heating system, the invention is not limited thereto. Any system wherein heat is transported by means of liquid circulating in a circuit is deemed to fall within the scope of the applied term "heating installation".

I claim:

1. Heating installation comprising a closed liquid circuit which is under pressure during operation, a pressureless liquid reservoir, an actuable pump with an inlet connected to the reservoir and an outlet connected to the circuit, an actuable drain to drain liquid out of the circuit to the reservoir, a pressure detector to detect the pressure in the circuit, a control to activate the pump when exceeding of a minimum pressure in a negative direction is detected and for activating the drain when exceeding of a maximum pressure in a positive direction is detected, a cover floating on the liquid arranged in the reservoir, and a passage for gas to pass from the reservoir to the atmosphere incorporated in the cover.

2. Heating installation as claimed in claim 1, wherein the drain and the pressure detector and control co-acting therewith are integrated into a pressure-relief valve.

3. Heating installation as claimed in claim 1, wherein said passage for gas is a non-return valve incorporated in the cover.

4. Heating installation comprising a closed liquid circuit which is under pressure during operation, a pressureless liquid reservoir, an actuable pump with an inlet connected to the reservoir and an outlet connected to the circuit, an actuable drain to drain liquid out of the circuit to the reservoir, a pressure detector to detect the pressure in the circuit, a control to activate the pump when exceeding of a minimum pressure in a negative direction is detected and for activating the drain when exceeding of a maximum pressure in a positive direction is detected, a cover floating on the liquid arranged in the reservoir, and wherein the cover comprises a downward extending casing.

5. Heating installation as claimed in claim 1, comprising a level detector to detect the liquid level in the reservoir.

6. Heating installation as claimed in claim 5, comprising a liquid source connected by an actuable valve to the reservoir, wherein the level detector can detect at least a lowest level and the control activates the valve when the lowest level is exceeded in negative direction.

7. Heating installation comprising a closed liquid circuit which is under pressure during operation, a pressureless liquid reservoir, an actuable pump with an inlet connected to the reservoir and an outlet connected to the circuit, an actuable drain to drain liquid out of the circuit to the reservoir, a pressure detector to detect the pressure in the circuit, a control to activate the pump when exceeding of a minimum pressure in a negative direction is detected and for activating the drain when exceeding of a maximum pressure in a positive direction is detected, a level detector to detect the liquid level in the reservoir, a liquid source connected by an actuable valve to the reservoir, wherein the level detector can detect at least a lowest level and the control activates the valve when the lowest level is exceeded in a negative direction, and a recorder to record the number of occasions per unit of time that the valve is activated.

8. Heating installation as claimed in claim 1, wherein the reservoir comprises an overflow connected to an outlet.

9. Heating installation as claimed in claim 1, wherein a filter is accommodated in a connecting line between the circuit and the liquid reservoir.

10. Heating installation comprising a closed liquid circuit which is under pressure during operation, a pressureless liquid reservoir, an actuable pump with an inlet connected to the reservoir and an outlet connected to the circuit, an actuable drain to drain liquid out of the circuit to the reservoir, a pressure detector to detect the pressure in the circuit, and a control to activate the pump when exceeding of a minimum pressure in a negative direction is detected and for activating the draining means when exceeding of a maximum pressure in a positive direction is detected, wherein the drain and the pressure detector and control co-acting therewith are integrated into a pressure-relief valve, and wherein a cover floating on the liquid is arranged in the reservoir.

11. Heating installation as claimed in claim 3, wherein the cover comprises a downward extending casing.

12. Heating installation as claimed in claim 2, comprising a level detector to detect the liquid level in the reservoir.

13. Heating installation as claimed in claim 2, wherein the reservoir comprises an overflow connected to an outlet.

14. Heating installation as claimed in claim 2, wherein a filter is accommodated in a connecting line between the circuit and the liquid reservoir.

15. Heating installation as claimed in claim 7, wherein the liquid source is a water main.

16. Heating installation as claimed in claim 8, wherein the liquid source is a water main.

* * * * *